US011255137B2

(12) United States Patent
Dietz et al.

(10) Patent No.: US 11,255,137 B2
(45) Date of Patent: Feb. 22, 2022

(54) HELICAL ALIGNMENT SLEEVE

(71) Applicant: Halliburton Energy Services, Inc., Houston, TX (US)

(72) Inventors: Wesley P. Dietz, Carrollton, TX (US); Matthew Bradley Stokes, Keller, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/080,321

(22) PCT Filed: Nov. 13, 2017

(86) PCT No.: PCT/US2017/061302
§ 371 (c)(1),
(2) Date: Aug. 28, 2018

(87) PCT Pub. No.: WO2019/094043
PCT Pub. Date: May 16, 2019

(65) Prior Publication Data
US 2021/0172266 A1 Jun. 10, 2021

(51) Int. Cl.
*E21B 17/22* (2006.01)
*E21B 17/10* (2006.01)
*E21B 23/02* (2006.01)

(52) U.S. Cl.
CPC ..... *E21B 17/22* (2013.01); *E21B 17/10* (2013.01); *E21B 23/02* (2013.01)

(58) Field of Classification Search
CPC ..... E21B 17/10; E21B 17/22; E21B 23/02; E21B 23/006
See application file for complete search history.

(56) References Cited

U.S. PATENT DOCUMENTS 3,656,562 A * 4/1972 Baugh ..... E21B 43/11852 175/4.51
3,934,648 A * 1/1976 Amancharla ..... E21B 23/02 166/116
6,012,527 A * 1/2000 Nitis ..... E21B 7/061 166/313
6,202,746 B1 3/2001 Vandenberg et al.
(Continued)

FOREIGN PATENT DOCUMENTS

SU 205749 A1 12/1967
SU 1733622 A1 5/1992
WO WO 99-39077 A1 8/1999

OTHER PUBLICATIONS

International Search Report and The Written Opinion of the International Search Authority, or the Declaration, dated Aug. 9, 2018, PCT/US2017/061302, 16 pages, ISA/KR.
(Continued)

*Primary Examiner* — David Carroll
(74) *Attorney, Agent, or Firm* — Haynes and Boone, LLP

(57) ABSTRACT

An apparatus includes a sleeve a sleeve having a slot defined by at least a first edge and a second edge of the sleeve. At least a portion of the first edge defines a left-handed helical portion of the slot. At least a portion of the second edge defines a right-handed helical portion of the slot. The left-handed helical portion and the right-handed helical portion are at different axial positions along the sleeve with respect to a center axis through the sleeve.

21 Claims, 13 Drawing Sheets

(56) References Cited

U.S. PATENT DOCUMENTS

2010/0282475 A1 11/2010 Darnell et al.
2015/0259999 A1* 9/2015 Gonzalez ..... E21B 23/02
166/385

OTHER PUBLICATIONS

English Translation of the Official Action issued by the Russian Patent and Trademark Office regarding Russian Patent Application No. 2020112348 (020856), dated Nov. 11, 2020, , 4 pages.
Official Action issued by the Russian Patent and Trademark Office, regarding Russian Patent Application No. 2020112348 (020856), dated Nov. 11, 2020, 2 pages.

* cited by examiner

HELICAL ALIGNMENT SLEEVE

PRIORITY

The present application is a U.S. National Stage patent application of International Patent Application No. PCT/US2017/061302, filed on Nov. 13 2017, the benefit of which is claimed and the disclosure of which is incorporated herein by reference in its entirety.

TECHNICAL FIELD

The present disclosure relates generally to an apparatus and method for radially and axially aligning a tubing string relative to a casing string in a wellbore, and more specifically, to an apparatus and method for aligning the tubing string to the casing string using an alignment sleeve having a slot with two different types of helical portions positioned at different locations axially along the alignment sleeve.

BACKGROUND

Generally, the construction of a well system includes stabilizing a wellbore with a casing string and positioning a tubing string within the casing string. Often, the tubing string needs to be aligned with, or positioned in a fixed angular position relative to, the casing string. For example, in some cases, the tubing string may include a window, or a portion through which a window can be formed, that needs to be aligned with a window in the casing string.

Various tools have been used to position a tubing string at a selected depth and angular position relative to the casing string in a wellbore. However, aligning a tubing string with a casing string in a wellbore may be difficult. For example, some currently available tools may rotate the tubing string by more than 180 degrees in one direction, which may cause undesired twisting or breakage of lines or cables (e.g. control lines, hydraulic lines, communication lines, electric lines, other types of lines or cables, or a combination thereof) connected to the tubing string. Another way of establishing a fixed angular position for a tubing string is to align the tubing string using a mule shoe. However, some currently available mule shoes do not provide up to 360 degrees of alignment for the tubing string within the wellbore. Further, the construction of some mule shoes may not be as strong as desired, causing these mule shoes to be more prone to breakage.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

FIG. 10 is an illustration of a perspective view of the assembly from FIG. 9 with the key in a third configuration, according to an example embodiment;

DETAILED DESCRIPTION

Figure 1:
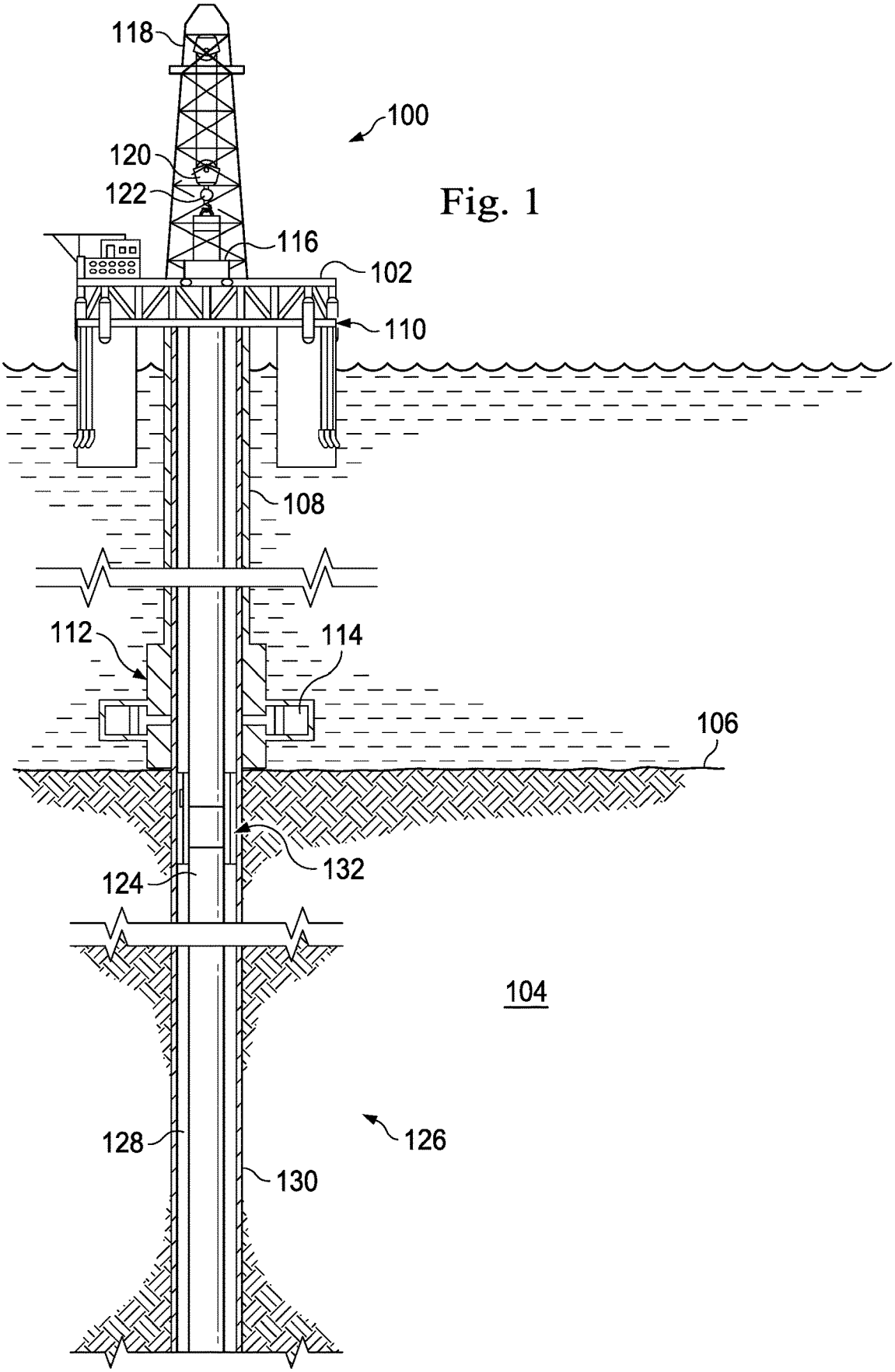
FIG. 1 is a schematic illustration of an offshore oil and gas platform, according to an example embodiment of the present disclosure.

Illustrative embodiments and related methods of the present disclosure are described below as they might be employed in a helical alignment sleeve and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the example term "below" may encompass both an orientation of above and below. The apparatus may be otherwise oriented (rotated 90 degrees or at other orientations) and the spatially relative descriptors used herein may likewise be interpreted accordingly.

FIG. 1 is a schematic illustration of an offshore oil and gas platform, generally designated 100. Even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores, or the like.

Referring still to the offshore oil and gas platform 100 of FIG. 1, a semi-submersible platform 102 may be positioned over a submerged oil and gas formation 104 located below a sea floor 106. A subsea conduit 108 may extend from a deck 110 of the semi-submersible platform 102 to a subsea wellhead installation 112, including blowout preventers 114. The semi-submersible platform 102 may have a hoisting apparatus 116, a derrick 118, a travel block 120, and a hook 122 for raising and lowering pipe strings, such as a substantially tubular, axially extending tubing string 124.

As in the present example embodiment of FIG. 1, a well system 126, which includes a main borehole or main wellbore 128, extends through the various earth strata including the submerged oil and gas formation 104, with a portion of the main wellbore 128 having a casing string 130 cemented therein. In other example embodiments, the well system 126 may also include lateral wellbores (not shown) that intersect with the main wellbore 128. This disclosure is not limited at all to the particular configuration of the well system 126. For example, any number of or arrangement of lateral wellbores may intersect with the main wellbore 128.

In the present example embodiment of FIG. 1, the tubing string 124 is aligned with the casing string 130 such that the tubing string 124 is in a fixed axial and angular relationship relative to the casing string 130. This alignment is achieved using a sleeve 132 (shown in greater detail in FIGS. 2-5, 9, and 10) coupled to the casing string 130. The sleeve 132 has a slot with two different types of helical portions that are positioned at different locations axially along the sleeve 132.

Figure 2:
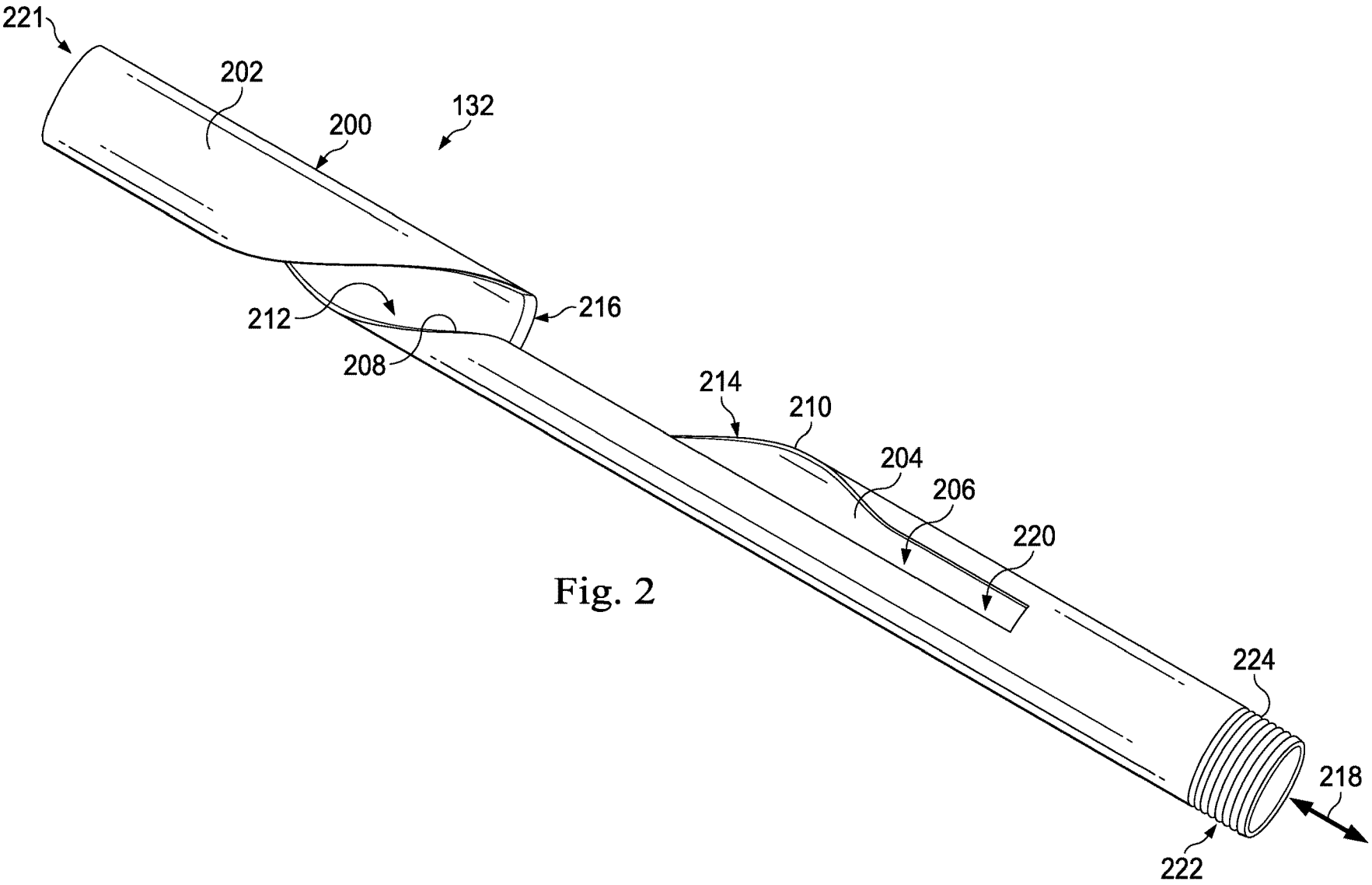
FIG. 2 is an illustration of a perspective view of the sleeve from FIG. 1, according to an example embodiment of the present disclosure.

FIG. 2 is an illustration of a perspective view of the sleeve 132 from FIG. 1. In an example embodiment, the sleeve 132, which may be also referred to as an alignment sleeve or a dual-helix alignment sleeve, includes a body 200. The body 200 of the sleeve 132 has an outer surface 202 and an inner surface 204. The sleeve 132 includes a slot 206 formed in the body 200. The slot 206 is defined by at least a first edge 208 and a second edge 210. Each of the first edge 208 and the second edge 210 defines a different helical portion of the slot 206. In one example embodiment, at least a portion of the first edge 208 defines a left-handed helical portion 212 of the slot 206 and at least a portion of the second edge 210 defines a right-handed helical portion 214 of the slot 206. The left-handed helical portion 212 forms a helical curve around the sleeve 132 that has left-handedness. The right-handed helical portion 214 forms a helical curve around the sleeve 132 that has right-handedness.

In one example embodiment, the left-handed helical portion 212 curves around the sleeve 132 to provide about 180 degrees of rotational alignment, and the right-handed helical portion 214 curves around the sleeve 132 to provide a different 180 degrees of rotational alignment. In this manner, the left-handed helical portion 212 and the right-handed helical portion 214 together provide about 360 degrees of rotational alignment. In one or more embodiments, the second edge 210 may begin defining the right-handed helical portion 214 at a position on the sleeve 132 that is diametrically opposed to a position on the sleeve 132 at which the first edge 208 finishes defining the left-handed helical portion 212. This type of configuration provides about 360 degrees of rotational alignment.

At least one of the first edge 208 and the second edge 210 includes a partitioning portion 216 located between the left-handed helical portion 212 of the slot 206 and the right-handed helical portion 214 of the slot 206. The partitioning portion 216 separates the left-handed helical portion 212 from the right-handed helical portion 214 of the slot 206. More particularly, the partitioning portion 216 separates the left-handed helical portion 212 from the right-handed helical portion 214 so that the left-handed helical portion 212 and the right-handed helical portion 214 are at different axial positions along the sleeve 132 with respect to an axis 218 through the sleeve 132. The axis 218 may be a center axis through the sleeve 132. In one or more embodiments, the left-handed helical portion 212 of the slot 206 does not overlap axially with the right-handed helical portion 214 of the slot 206.

In one example embodiment, the partitioning portion 216 is defined by the second edge 210 and is positioned adjacent to the portion of the second edge 210 that defines the right-handed helical portion 214. In one or more embodiments, the partitioning portion 216 extends circumferentially around at least a portion of the sleeve 132 such that the partitioning portion 216 lies along a radial cross-section of the sleeve 132, the radial cross-section being taken with respect to an axis 218 through the sleeve 132. For example, the partitioning portion 216, in substantially its entirety, may be located substantially parallel to a radial plane that is perpendicular to the axis 218. In this example, the partitioning portion 216, in substantially its entirety, may be substantially perpendicular to the axis 218.

The slot 206 includes a landing portion 220. In one or more embodiments, the landing portion 220 is defined by at least the first edge 208 and the second edge 210. The landing portion 220 is positioned along the sleeve 132 such that the landing portion 220 has a selected angular position relative to the casing string 130 when the sleeve 132 is coupled to the casing string 130 in FIG. 1.

The sleeve 132 has a first end 221 and a second end 222. In one or more embodiments, the sleeve 132 includes outer threads 224 located at or near second end 222 of the sleeve 132. In one example embodiment, the outer threads 224 may engage inner threads (not shown) on the casing string 130 to lock the sleeve 132 in a selected angular position and at a selected axial position relative to the casing string 130, thereby locking the landing portion 220 of the slot 206 in a selected angular position relative to the casing string 130.

Figure 3:
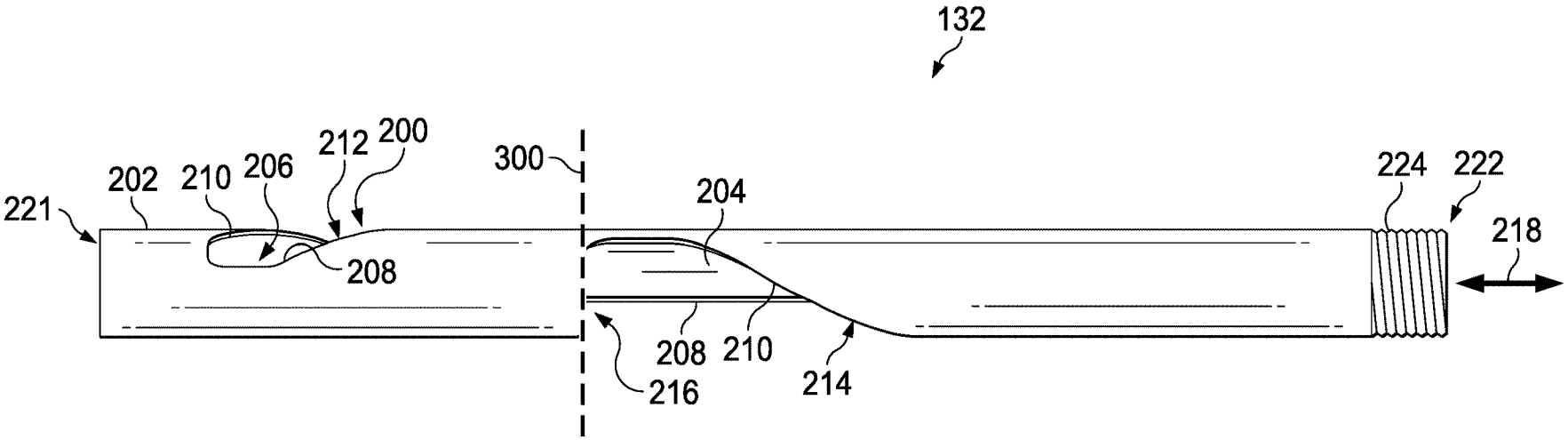
FIG. 3 is an illustration of a side view of the sleeve from FIG. 2, according to an example embodiment of the present disclosure.

FIG. 3 is an illustration of a side view of the sleeve 132 from FIG. 2. In this example embodiment, the partitioning portion 216 lies along a radial cross-section of the sleeve 132, taken at a radial plane 300 through the sleeve 132. In one example embodiment, the partitioning portion 216 extends circumferentially along the radial plane 300 about 180 degrees around the sleeve 132. In another embodiment, the partitioning portion 216 extends along the radial plane 300 at least about 20 degrees around the sleeve 132. In other embodiments, the partitioning portion 216 may extend along the radial plane 300 between about 20 degrees and about 180 degrees around the sleeve.

As shown in FIGS. 2 and 3, the slot 206 is positioned between the first end 221 and the second end 222 of the sleeve 132 such that the slot 206 is closed, not open, at each of its ends. In other words, the slot 206 begins at a selected distance from the first end 221 of the sleeve 132 and ends at a selected distance from the second end 222 of the sleeve 132. This configuration of the sleeve 132 with the slot 206 having closed ends strengthens the sleeve 132 to help the sleeve 132 resist breakage when the tubing string 124 is moved into and through the sleeve 132.

Figure 4:
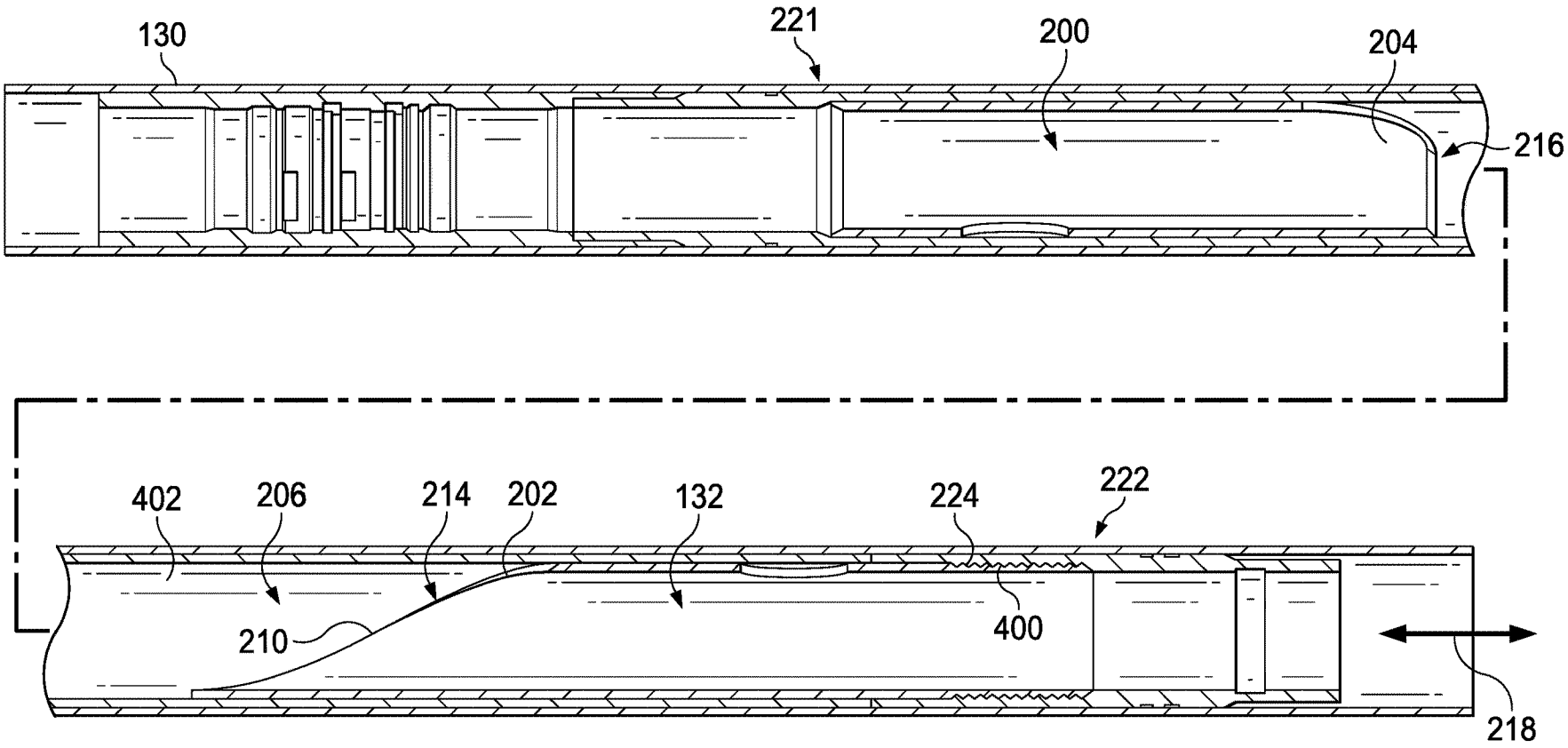
FIG. 4 is an illustration of a cross-sectional view of an assembly of the sleeve from FIGS. 2 and 3 positioned within a portion of the casing string from FIG. 1, according to an example embodiment of the present disclosure.

FIG. 4 is an illustration of a cross-sectional view of an assembly of the sleeve 132 from FIGS. 2 and 3 positioned within a portion of the casing string 130 from FIG. 1. The outer threads 224 of the sleeve 132 are engaged with inner threads 400 of the casing string 130 to lock the sleeve 132 in a selected angular position and at a selected axial position relative to the casing string 130 within a wellbore, such as the main wellbore 128. In FIG. 4, an inner surface 402 of the casing string 130 is visible through the slot 206.

Figure 5:
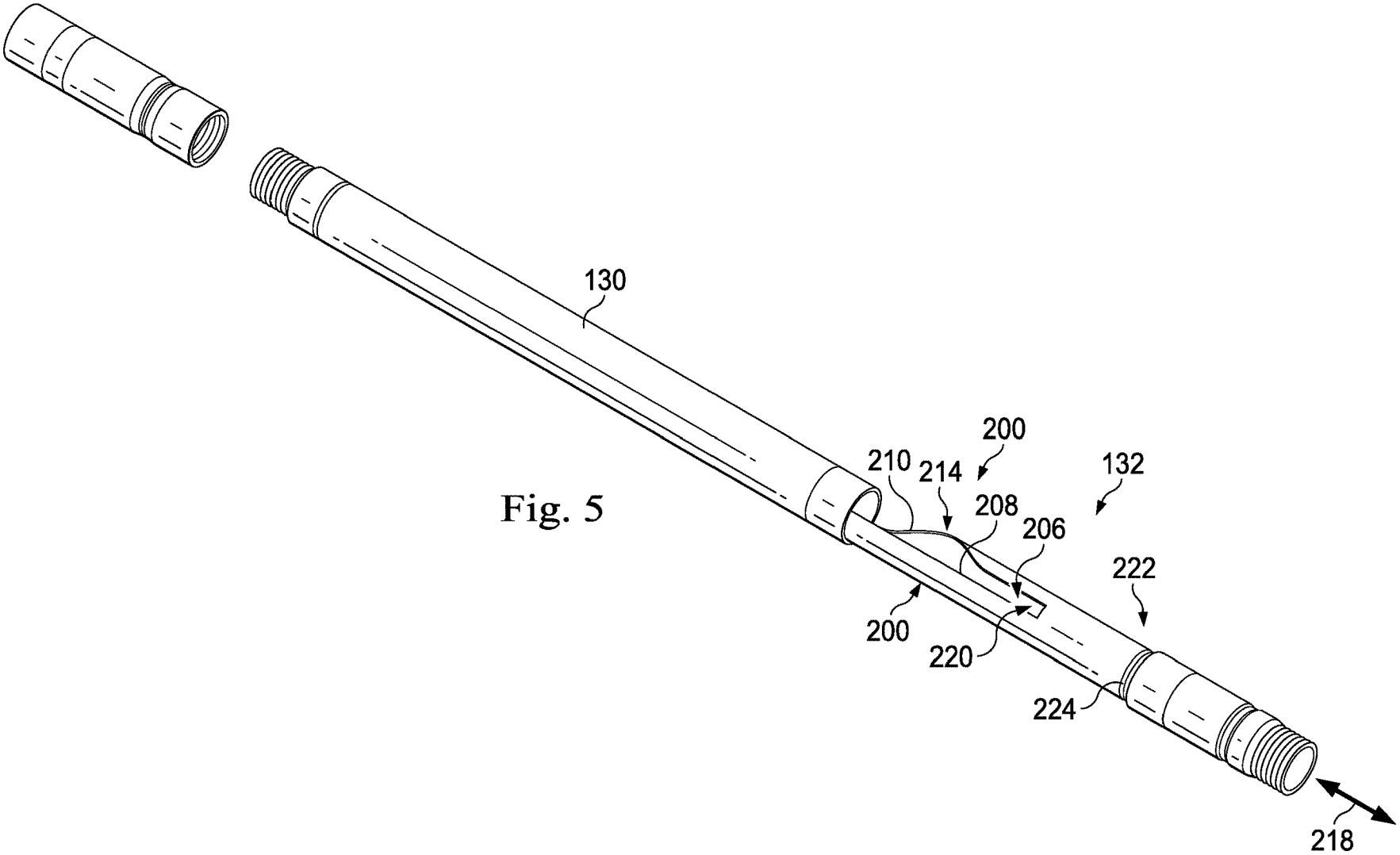
FIG. 5 is an illustration of a partially exploded perspective view of the assembly of the sleeve and the casing string from FIG. 4, according to an example embodiment of the present disclosure.

FIG. 5 is an illustration of a partially exploded perspective view of the assembly of the sleeve 132 and the casing string 130 from FIG. 4. As depicted in FIG. 5, the sleeve 132 may be moved axially relative to the casing string 130 and then secured to the casing string 130.

Figure 6:
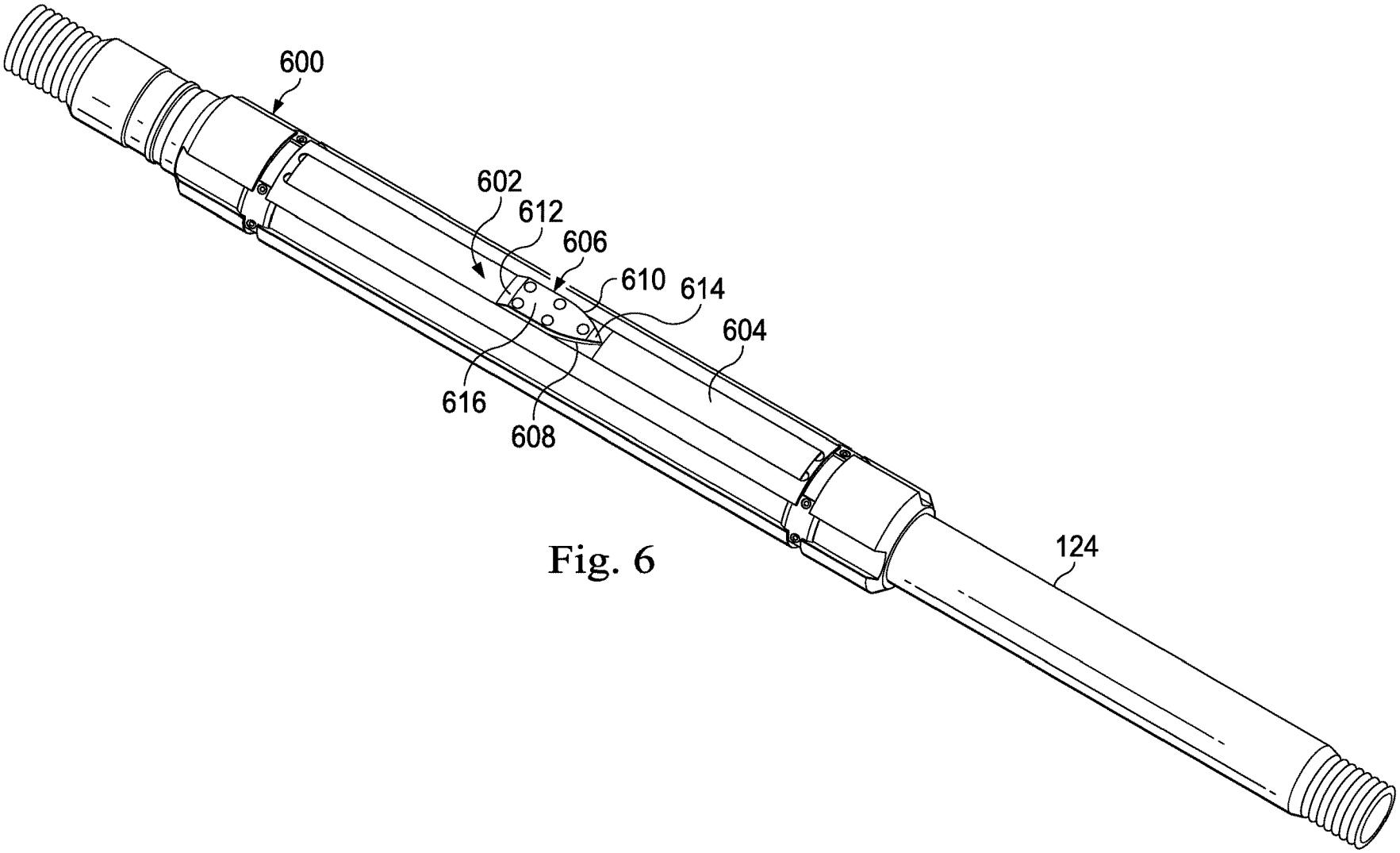
FIG. 6 is an illustration of a perspective view of the tubing string from FIG. 1 with a coupling device and a key coupled to the tubing string, according to an example embodiment of the present disclosure.

FIG. 6 is an illustration of a perspective view of the tubing string 124 from FIG. 1 with a coupling device 600 and a key 602 coupled to the tubing string 124. In one embodiment, the coupling device 600 is a mechanism coupled to the tubing string 124 at a fixed location along the tubing string 124. The key 602 is coupled to the coupling device 600. Thus, the coupling device 600 couples the key 602 to the tubing string 124. Depending on the implementation, the coupling device 600 may be implemented in various ways. More particularly, the coupling device 600 may be implemented in any manner that allows the key 602 to be coupled to the coupling device 600 and the coupling device 600 to be coupled to the tubing string 124. Further, the coupling device 600 may be implemented in any manner that enables the tubing string 124 with the coupling device 600 and the key 602 coupled to the tubing string 124 to still fit within the sleeve 132 and move axially through the sleeve 132.

In one example embodiment, the key 602 includes an elongate member 604 and a projecting member 606. The projecting member 606 extends outward from the elongate member 604, which generally extends longitudinally along the coupling device 600, such that the key 602 projects radially outward and away from the tubing string 124 when the key 602 is coupled to the tubing string 124. In one example embodiment, the elongate member 604 is sized such that the elongate member 604 does not extend outward from the tubing string 124 beyond an outermost point of the coupling device 600.

The projecting member 606 includes two opposing side surfaces, which include a first curved surface 608 and a second curved surface 610. Further, the projecting member 606 includes a first end surface 612, a second end surface 614, and a base surface 616. The first end surface 612 and the second end surface 614 are opposing end surfaces.

Each of the first curved surface 608 and the second curved surface 610 has a curvature that is shaped to substantially conform to the curvature of a helix. More particularly, each of the first curved surface 608 and the second curved surface 610 has a curvature that is shaped to substantially conform to the curvature of a helical portion of the slot 206 of the sleeve 132 shown in FIGS. 2 and 3. In one example embodiment, the first curved surface 608 has a curvature that is shaped to substantially conform to the curvature of the portion of the first edge 208 that defines the left-handed helical portion 212 (in FIGS. 2 and 3) of the slot 206. In one example embodiment, the second curved surface 610 has a curvature that is shaped to substantially conform to the curvature of the portion of the second edge 210 that defines the right-handed helical portion 214 (in FIGS. 2 and 3) of the slot 206.

The first end surface 612 connects the first curved surface 608 and the second curved surface 610 at one end of the projecting member 606, while the second end surface 614 connects the first curved surface 608 and the second curved surface 610 at the opposing end of the projecting member 606. The base surface 616 is the outward facing surface of the projecting member 606.

Figure 7:
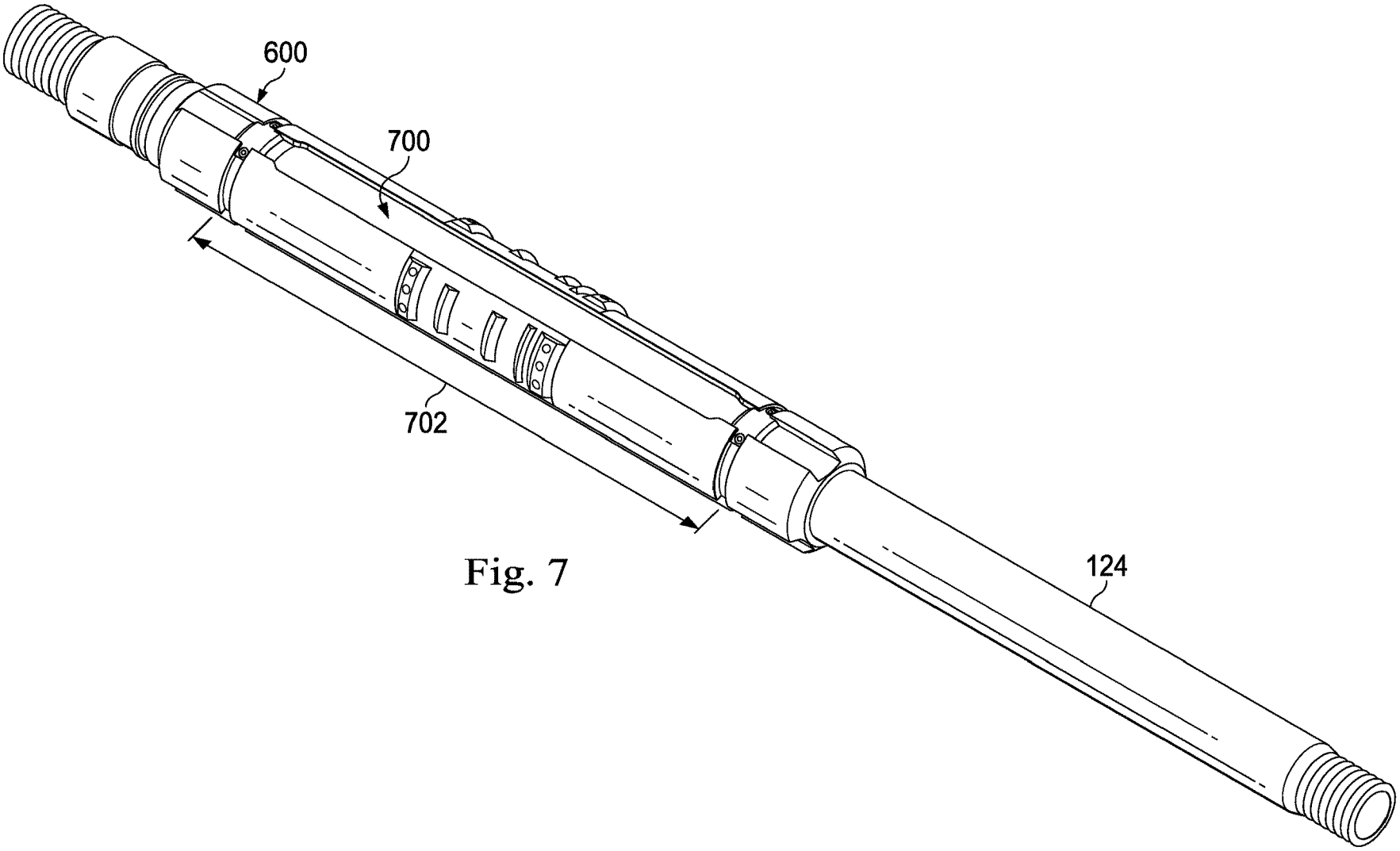
FIG. 7 is an illustration of a perspective view of the coupling device coupled to the tubing string without the key from FIG. 6, according to an example embodiment of the present disclosure.

FIG. 7 is an illustration of a perspective view of the coupling device 600 coupled to the tubing string 124 without the key 602 from FIG. 6. In one example embodiment, the coupling device 600 includes a key slot 700 for receiving the key 602 from FIG. 6. In one example embodiment, the key slot 700 has a length 702 that is at least as long as a length of the elongate member 604 of the key 602.

Figure 8:
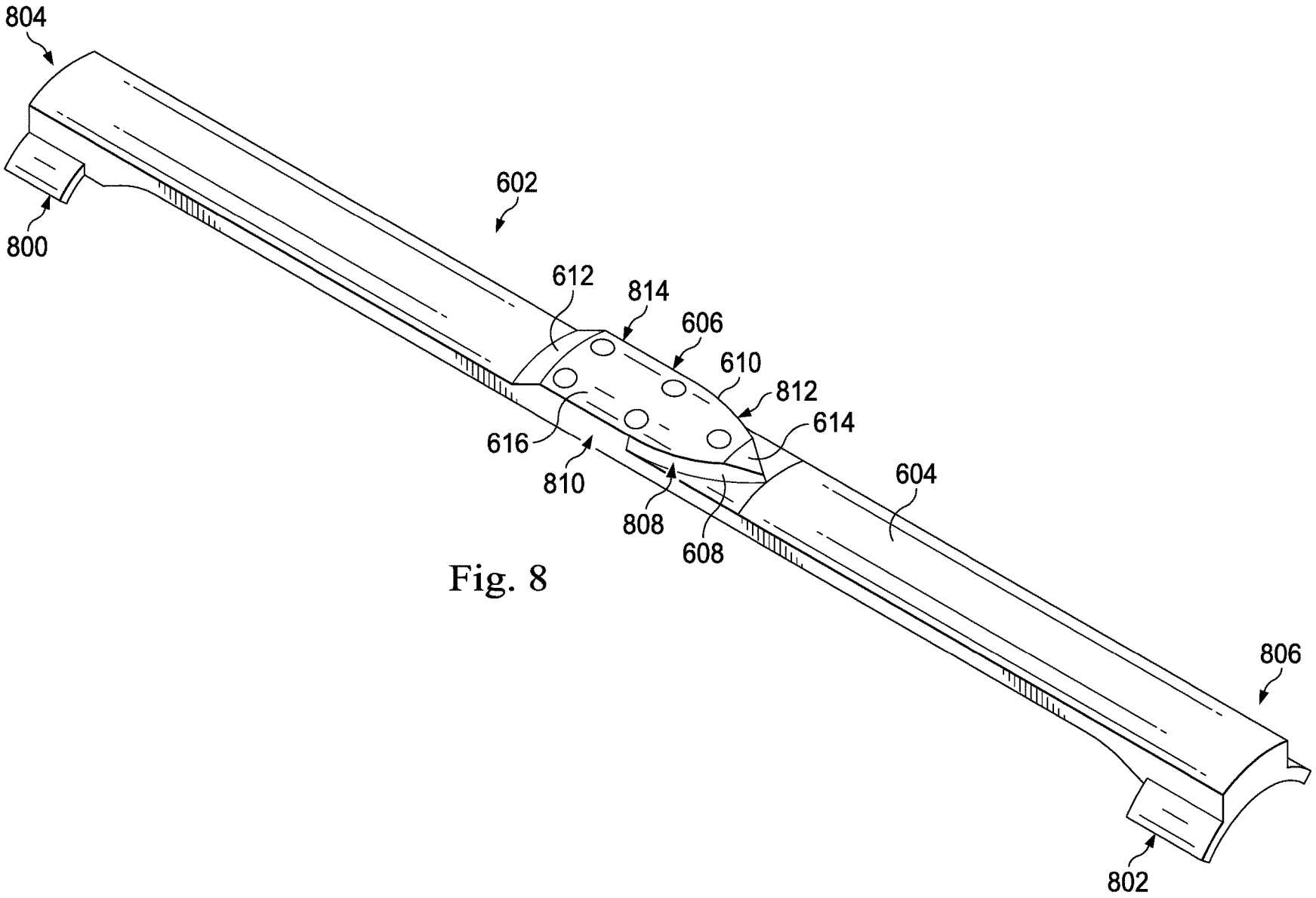
FIG. 8 is an illustration of a perspective view of the key from FIG. 6, according to an example embodiment of the present disclosure.

FIG. 8 is an illustration of a perspective view of the key 602 from FIG. 6. The various surfaces of the key 602 are more clearly seen in this figure. In one example embodiment, the key 602 includes a first connecting element 800 and a second connecting element 802 at a first end 804 and a second end 806, respectively, of the key 602. The first connecting element 800 and the second connecting element 802 are used to couple the key 602 to the coupling device 600 (in FIGS. 6 and 7). More particularly, the first connecting element 800 and the second connecting element 802 fit within the key slot 700 of the coupling device 600 (in FIG. 7) to couple the elongate member 604 of the key 602 to the coupling device 600.

In one example embodiment, as shown in FIG. 8, the first curved surface 608 of the key 602 includes a curved portion 808 and a substantially straight portion 810, and the second curved surface 610 includes a curved portion 812 and a substantially straight portion 814. However, in one or more other example embodiments, the first curved surface 608 may be curved in its entirety, the second curved surface 610 may be curved in its entirety, or both the first curved surface 608 and the second curved surface 610 may be curved in their entirety.

In one or more example embodiments, the projecting member 606 may be movable relative to the elongate member 604. More particularly, the projecting member 606 may be movable, in a radial direction, towards the elongate member 604 and away from the elongate member 604. For example, the key 602 may include a biasing device (not shown) that loads the projecting member 606. When a force or pressure is applied to the projecting member 606, the projecting member 606 is pushed down towards the elongate member 604. But the biasing device loads the projecting member 606 such that, once the force or pressure being applied to the projecting member 606 is reduced or removed, the projecting member 606 extends outward from the elongate member 604. The biasing device may be implemented using, for example, without limitation, a spring.

Figure 9:
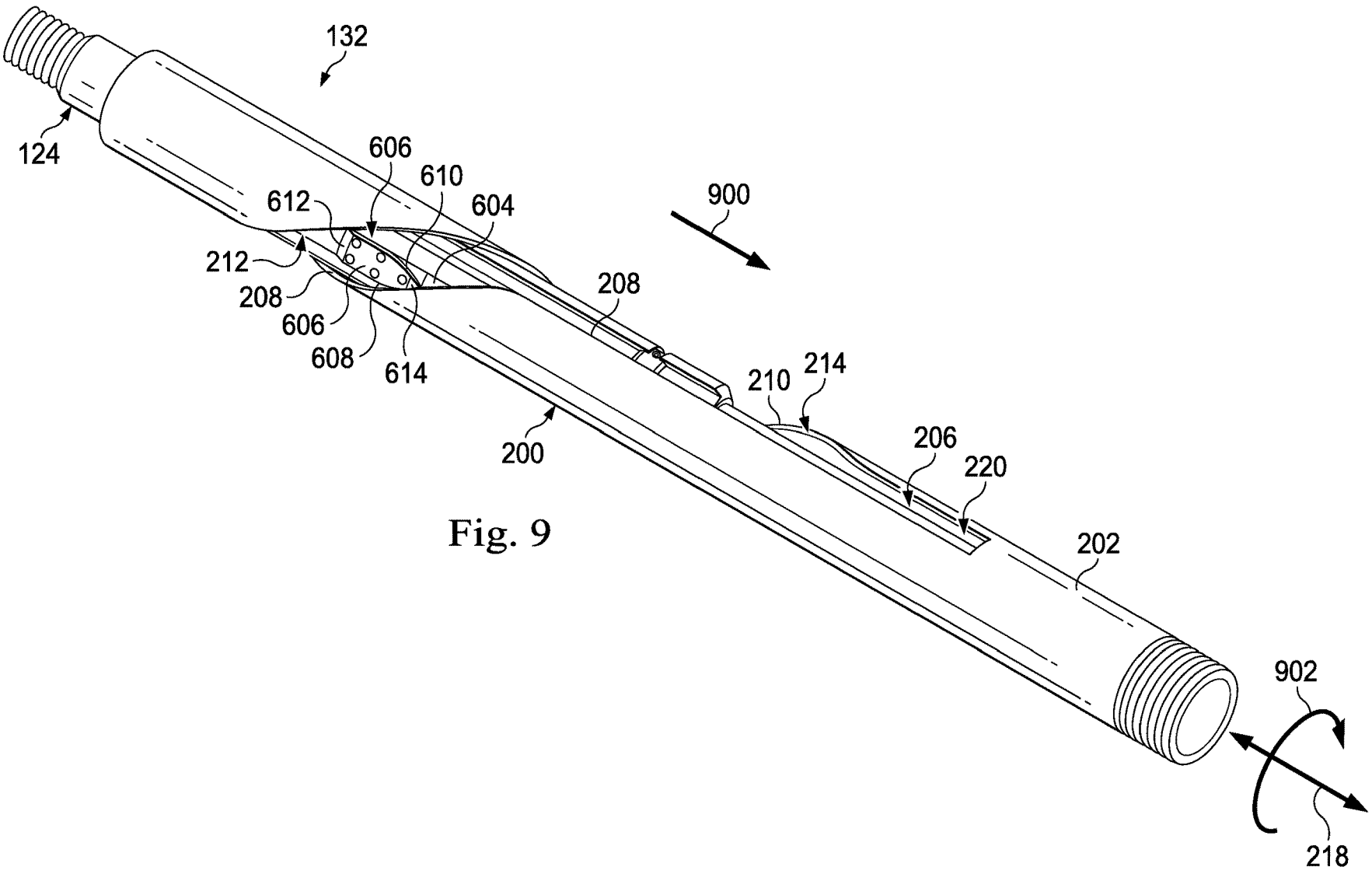
FIG. 9 is an illustration of a perspective view of an assembly of the sleeve, the tubing string, the coupling device, and the key with the key in a first configuration, according to an example embodiment of the present disclosure.

FIG. 9 is an illustration of a perspective view of an assembly of the sleeve 132, the tubing string 124, the coupling device 600, and the key 602 with the key 602 in a first configuration. In FIG. 9, the tubing string 124, with the coupling device 600 and the key 602 coupled to the tubing string 124, is moving through the sleeve 132 in an axial direction 900 along the axis 218. As the tubing string 124 moves through the sleeve 132 in the axial direction 900, the projecting member 606 of the key 602 is also moved in the axial direction 900. Because the slot 206 provides up to 360 degrees of alignment, the key 602 will radially align with the slot 206 at some point while passing through the sleeve 182. More particularly, the projecting member 606 of the key 602 may project outward from the tubing string 124 and through the slot 206 of the sleeve 132 at some point within the slot 206 and still be able to be aligned with the sleeve 132. More particularly, the projecting member 606 of the key 602 may extend outward and through the slot 206 at some point within the left-handed helical portion 212 or the right-handed helical portion 214 of the slot 206, depending on the radial alignment of the coupling device 600 relative to the sleeve 182.

In one example embodiment, the projecting member 606 first enters the slot 206 within the left-handed helical portion 212 of the slot 206 such that the key 602 engages the portion of the first edge 208 that defines the left-handed helical portion 212 of the slot 206. More particularly, the first curved surface 608 of the projecting member 606 engages the portion of the first edge 208 that defines the left-handed helical portion 212. Thus, as the tubing string 124 moves further in the axial direction 900, the key 602 rotates in a first rotational direction 902 about the axis 218, which in turn, rotates the tubing string 124 in the first rotational direction 902. The left-handed helical portion 212 provides up to about 180 degrees of alignment around the sleeve 132. Thus, the projecting member 606 may be rotated in the first rotational direction 902 about the axis 218 up to about 180 degrees, depending on the point along the slot 206 at which the projecting member 606 first enters the slot 206.

During movement of the tubing string 124 in the axial direction 900, but prior to the projecting member 606 axially reaching the slot 206, the projecting member 606 is pushed down towards the elongate member 604. But the projecting member 606 may be loaded such that, once the projecting member 606 is fully positioned under the slot 206, the projecting member 606 extends outward from the elongate member 604 to enter the slot 206.

Figure 10:
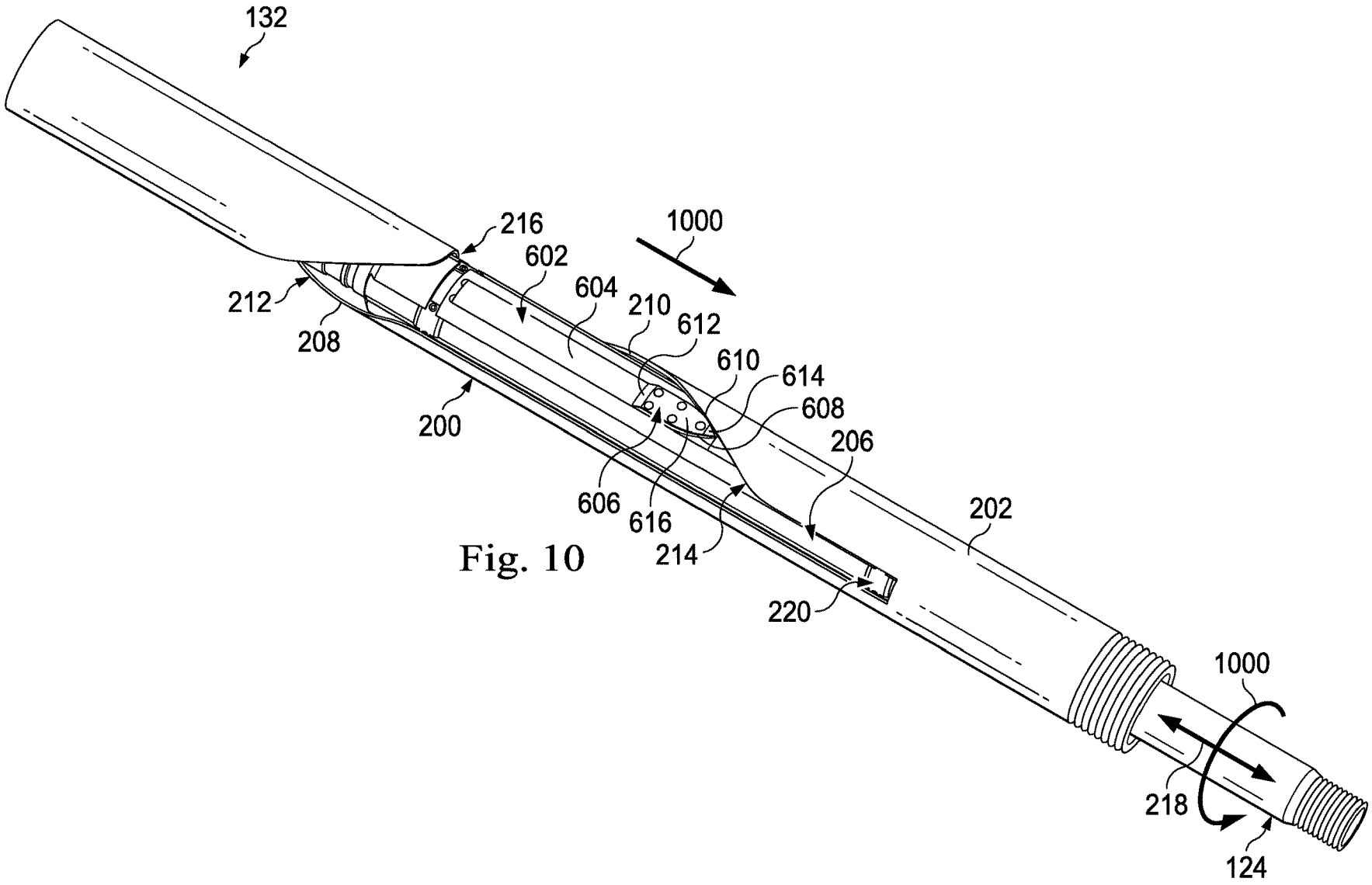
FIG. 10 is an illustration of a perspective view of the assembly from FIG. 9 with the key in a second configuration, according to an example embodiment.

FIG. 10 is an illustration of a perspective view of the assembly from FIG. 9 with the key 602 in a second configuration. More particularly, the second curved surface 610 of the projecting member 606 engages the portion of the second edge 210 that defines the right-handed helical portion 214 of the slot 206. Thus, as the tubing string 124 moves further in the axial direction 900 along the axis 218, the key 602 rotates in a second rotational direction 1000 about the axis 218, which in turn, rotates the tubing string 124 in the second rotation direction 1000. The second rotational direction 1000 is opposite the first rotational direction 902 shown in FIG. 9. The right-handed helical portion 214 provides up to about 180 degrees of alignment around the sleeve 132. Thus, the projecting member 606 may be rotated in the second rotational direction 1000 about the axis 218 up to about 180 degrees, depending on the point along the slot 206 at which the projecting member 606 first enters the right-handed helical portion 214 of the slot 206.

The key 602 continues to rotate as the tubing string 124 moves in the axial direction 900 until the key 602 reaches and moves into the landing portion 220 of the slot 206. The key 602 moving into the landing portion 220 of the slot 206 locks the tubing string 124 in a selected angular position relative to the sleeve 132, and thereby, relative to the casing string 130 (in FIGS. 1 and 4) to which the sleeve 132 is coupled.

In this manner, the key 602, and thereby the tubing string 124 coupled to the key 602, may be rotated as needed up to 360 degrees to align the tubing string 124 in a selected angular position without having to rotate more than 180 degrees in a single rotational direction. Rather, for example, the key 602 may be rotated about 45 degrees in the first rotational direction 902 about the axis 218 and about 180 degrees in the second rotational direction 1000 about the axis 218 to move the projecting member 606 of the key 602 into the landing portion 220 of the slot 206. The ability to align the key 602, and thereby the tubing string 124, up to about 360 degrees without rotating the key 602, and thereby the tubing string 124, more than 180 degrees in any single rotational direction may help reduce twisting and breakage of any lines or cables (e.g. control lines, power lines, communication lines, hydraulic lines, other types of lines or cables, or combination thereof) connected to the tubing string 124.

Figure 11:
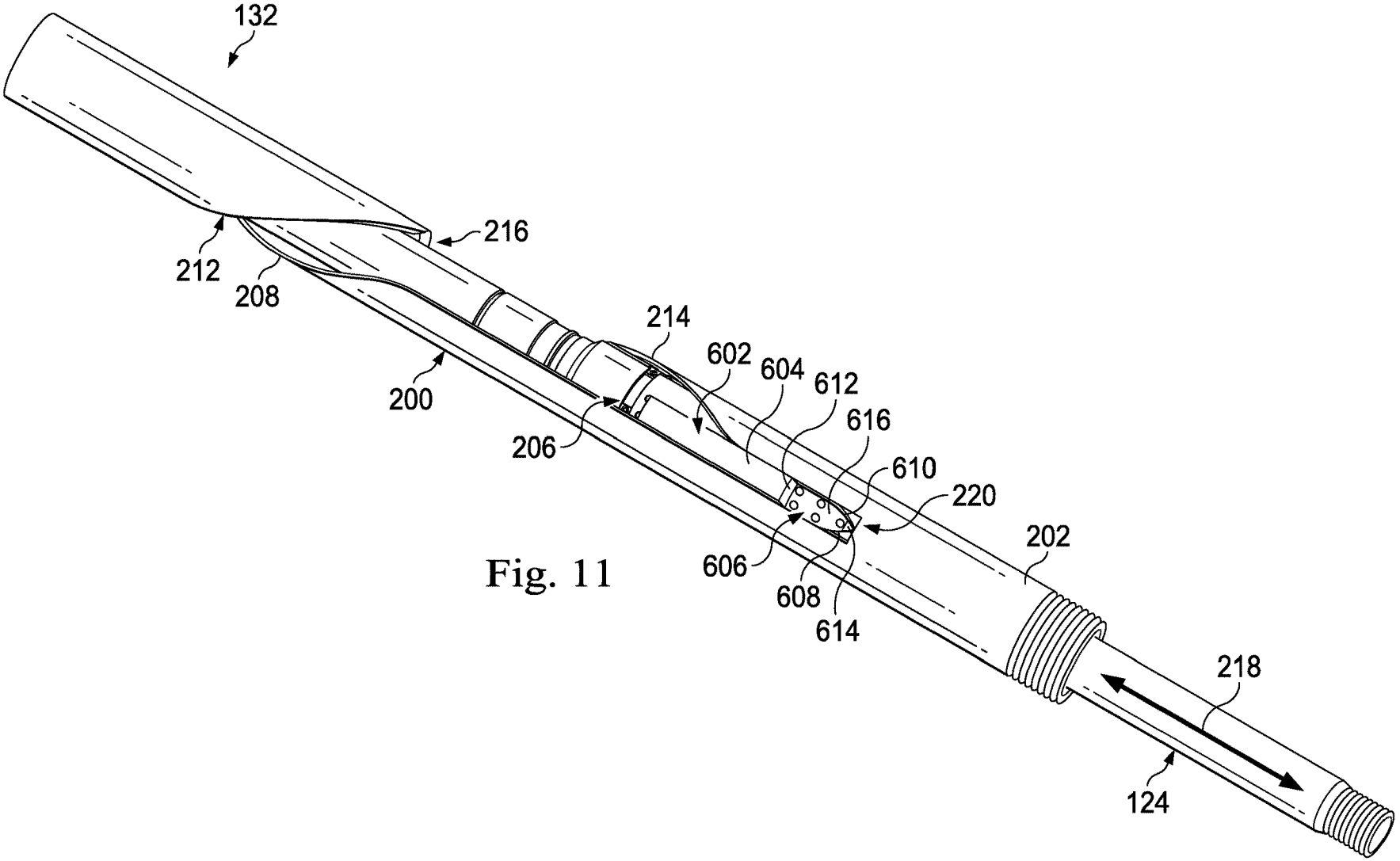

FIG. 11 is an illustration of a perspective view of the assembly from FIGS. 9 and 10 with the key 602 in a third configuration. The projecting member 606 of the key 602 has been moved into the landing portion 220 of the slot 206. Once the key 602 is moved into the landing portion 220, the key 602, and thereby the tubing string 124, is locked in a selected angular position relative to the sleeve 132, as determined by the selected angular position of the landing portion 220 relative to the casing string 130.

In one or more embodiments, the sleeve 132 described in the various embodiments may be used to align a particular portion of the tubing string 124 with a particular portion of the casing string 130 in FIGS. 1, 4, and 5. For example, the sleeve 132 may be used to align a first component of the tubing string 124 with a second component of the casing string 130. The first component may be, for example, a window or section of the tubing string 124 that must be axially and radially aligned with the casing string 130. Similarly, the second component may be, for example, a window of the casing string 130. Thus, a window of the tubing string 124, or a portion of the tubing string 124 to be formed into a window, may be aligned with a corresponding window of the casing string 130. This type of alignment may be particularly useful for aligning tubing strings in multilateral wellbores. In other embodiments, the first component of the tubing string 124 may be a structural feature, a section of the tubing string 124, a fastener device, a marker, or some other type of component or feature. The second component of the casing string 130 may be a structural feature, a section of the casing string 130, a fastener device, a marker, or some other type of component or feature.

Figure 12:
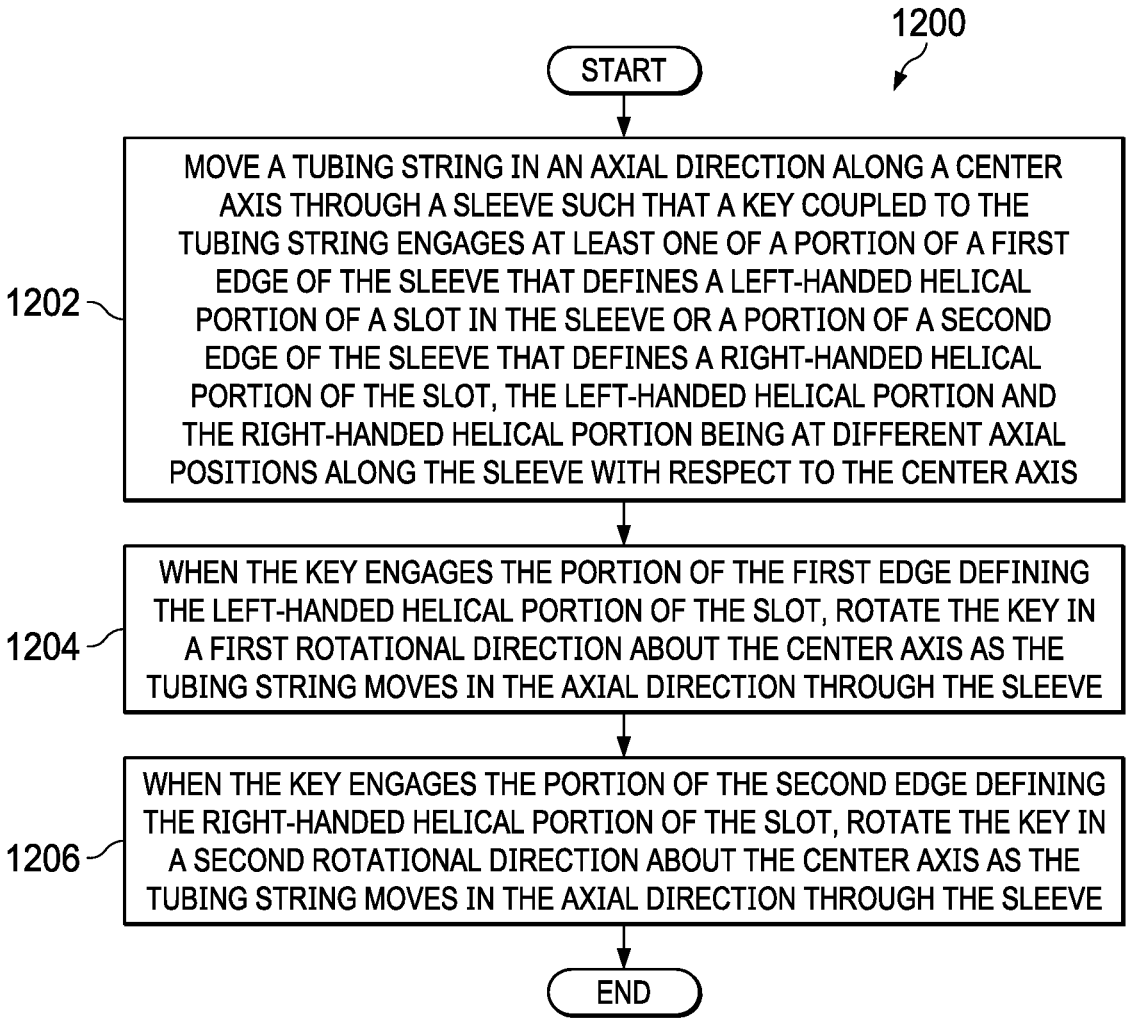
FIG. 12 is a flowchart illustration of a method for aligning a tubing string using a sleeve, with continuing reference to FIGS. 1-11, according to an example embodiment.

FIG. 12 is a flowchart illustration of a method 1200 for aligning a tubing string using a sleeve, with continuing reference to FIGS. 1-11. The method 1200 includes, at step 1202, moving the tubing string 124 in an axial direction along the axis 218 through the sleeve 132 such that the key 602 coupled to the tubing string 124 engages at least one of a portion of the first edge 208 of the sleeve 132 that defines the left-handed helical portion 212 of the slot 206 in the sleeve 132 or a portion of the second edge 210 of the sleeve 132 that defines the right-handed helical portion 214 of the slot 206, the left-handed helical portion 212 and the right-handed helical portion 214 being positioned at different axial positions along the sleeve 132 with respect to the axis 218.

In one or more embodiments, prior to the step 1202 and as the tubing string 124 is moved axially, a portion of the sleeve 132 may apply a force or pressure to the projecting member 606 of the key 602 that pushes the projecting member 606 down towards the elongate member 604 of the key 602. As the tubing string 124 moves further into the sleeve 132, the projecting member 606 may move into a position under the slot 206. Once at least the base surface 616 of the projecting member 606 has moved fully under the slot 206, the biasing of the projecting member 606 causes the projecting member 606 to extend outward away from the tubing string 124 and through the slot 206. The projecting member 606 enters the slot 206 within either the left-handed helical portion 212 or the right-handed helical portion 214 at the step 1202.

At the step 1204 and when the key 602 engages the portion of the first edge 208 of the sleeve 132 defining the left-handed helical portion 212 of the slot 206, the key 602 is rotated in a first rotational direction 902 about the axis 218 through the sleeve 132 as the tubing string 124 moves in the axial direction through the sleeve 132. For example, the first curved surface 608 of the projecting member 606 of the key 602 may substantially conform to the portion of the first edge 208 of the slot 206 that defines the left-handed helical portion 212. As the tubing string 124 moves axially relative to the sleeve 132, the projecting member 606 is rotated in the first rotational direction 902 such that the first curved surface 608 of the projecting member 606 slides along the portion of the first edge 208 defining the left-handed helical portion 212.

At the step 1206 and when the key 602 engages the portion of the second edge 210 of the sleeve 132 defining the right-handed helical portion 214 of the slot 206, the key 602 is rotated in a second rotational direction 1000 about the axis 218 through the sleeve 132 as the tubing string 124 moves in the axial direction through to the sleeve 132. For example, the second curved surface 610 of the projecting member 606 of the key 602 may substantially conform to the portion of the second edge 210 of the slot 206 that defines the right-handed helical portion 214. As the tubing string 124 moves axially relative to the sleeve 132, the projecting member 606 is rotated in the second rotational direction 1000 such that the second curved surface 610 of the projecting member 606 slides along the portion of the second edge 210 defining the right-handed helical portion 214.

In one example embodiment, when the projecting member 606 enters the slot 206 within the left-handed helical portion 212, alignment of the key 602 requires rotation of the key 602 along both the left-handed helical portion 212 and the right-handed helical portion 214. When the projecting member 606 enters the slot 206 within the right-handed helical portion 214, alignment of the key 602 may only require rotation of the key 602 along the right-handed helical portion 214.

Thus, in some situations, the key 602 rotates both in the first rotational direction 902 and in the second rotational direction 1000 to properly align the tubing string 124. For example, when the projecting member 606 of the key 602 enters the slot 206 at the left-handed helical portion 212 of the slot 206, the projecting member 606 rotates in the first rotational direction until the projecting member 606 reaches the partitioning portion 216. Once the projecting member 606 reaches the partitioning portion 216, the projecting member 606 then rotates in the second rotational direction 1000 until the projecting member 606 moves into the landing portion 220, which locks the key 602 in a selected angular and axial position relative to the sleeve 132.

Figure 13:
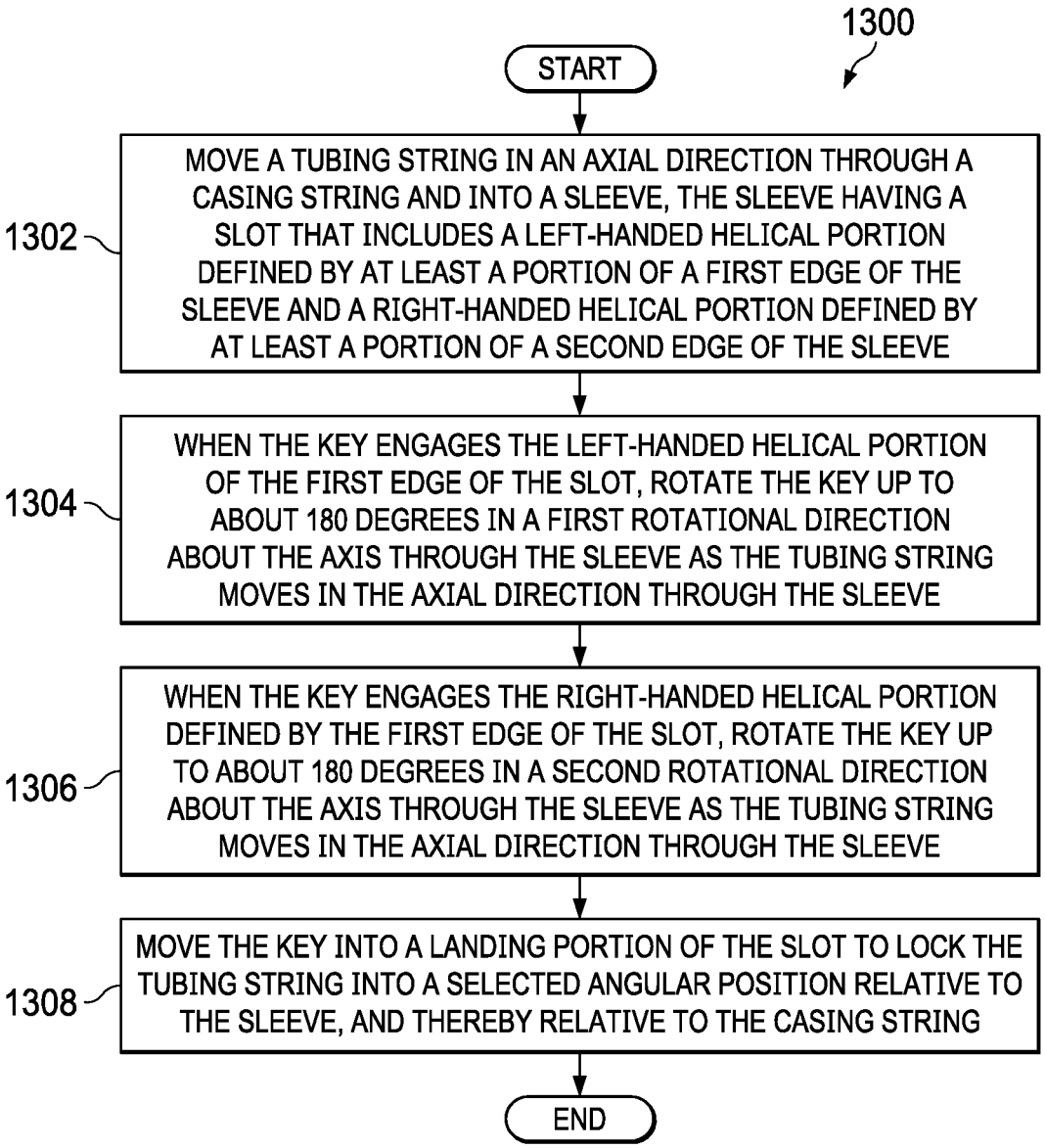
FIG. 13 is a flowchart illustration of a method for aligning a tubing string with a casing string in a wellbore, with continuing reference to FIGS. 1-11, according to an example embodiment.

FIG. 13 is a flowchart illustration of a method 1300 for aligning a tubing string with a casing string in a wellbore, with continuing reference to FIGS. 1-11. The method 1300 includes, at step 1302, moving the tubing string 124 in an axial direction through the casing string 130 and into the sleeve 132, the sleeve 132 having the slot 206 with the left-handed helical portion 212 defined by at least a portion of the first edge 208 of the slot 206 and the right-handed helical portion 214 defined by at least a portion of the second edge 210 of the slot 206. In one or more embodiments, the left-handed helical portion 212 and the right-handed helical portion 214 are positioned at different axial positions along the sleeve 132 so that the left-handed helical portion 212 and the right-handed helical portion 214 do not overlap axially.

At the step 1304, the key 602 is rotated up to about 180 degrees in the first rotational direction about the axis 218 through the sleeve 132 as the tubing string 124 moves in the axial direction 900 through the sleeve 132, when the key 602 engages the left-handed helical portion 212 defined by the first edge 208 of the slot 206.

At the step 1306, the key 602 is rotated up to about 180 degrees in the second rotational direction about the axis 218 through the sleeve 132 as the tubing string 124 moves in the axial direction 900 through the sleeve 132, when the key 602 engages the right-handed helical portion defined by the second edge 210 of the slot 206.

In one or more embodiments, the key 602 rotates both in the first rotational direction 902 and in the second rotational direction 1000. For example, when the projecting member 606 of the key 602 enters the slot 206 at the left-handed helical portion 212 of the slot 206, the projecting member 606 rotates in the first rotational direction 902 until the projecting member 606 reaches the partitioning portion 216. Once the projecting member 606 reaches the partitioning portion 216, the projecting member 606 then rotates in the second rotational direction 1000.

At the step 1308, the key 602 is then moved into the landing portion 220 of the slot 206 to lock the tubing string 124 in a selected angular position relative to the sleeve 132, and thereby, relative to the casing string 130. Thus, the sleeve 132 provides up to about 360 degrees of alignment for the key 602 and the tubing string 124.

Although the sleeve 132 has been described in a particular manner in the various embodiments, a dual-helix alignment sleeve may be implemented in other ways. For example, the body 200 of the sleeve 132 described above may be a singular integrally formed body. However, in other embodiments, the sleeve 132 may be formed by joining together two or more body sections. In one or more embodiments, a first body section having a slot that includes a left-handed alignment portion may be joined with a second body section having a slot that includes a right-handed alignment portion. The interface at which these two body sections are joined may form the partitioning portion 216. Further, the joining of the two slots may form a single slot.

In other embodiments, the slot 206 of the sleeve 132 may include two different left-handed helical portions that are positioned at different locations axially along the sleeve 132 and two different right-handed helical portions that are positioned at different locations axially along the sleeve 132. In some embodiments, a portion of the partitioning portion 216 does not run substantially parallel to the radial plane 300. In some embodiments, no portion of the partitioning portion 216 runs substantially parallel to the radial plane 300.

Although the sleeve 132 has been described as having outer threads 224 at or near the second end 222 of the sleeve 132, in other embodiments, the sleeve 132 may have some other structural feature that enables the sleeve 132 to be coupled to the casing string 130 at a fixed position. This other feature may take the form of, for example, but is not limited to, a latch mechanism, a fastener device, some other type of coupling device, or a combination thereof In some embodiments, a sleeve, similar to the sleeve 132, may be formed as part of the casing string 130, rather than a separate component. In these types of embodiments, the sleeve may be formed by machining a groove directly into the inner surface 402 of the casing string 130 to form the slot of the sleeve.

Thus, an apparatus for aligning a tubing string with a casing string in a wellbore has been described. Embodiments of the tool may generally include a sleeve having a slot defined by at least a first edge and a second edge of the sleeve. At least a portion of the first edge defines a left-handed helical portion of the slot, and at least a portion of the second edge defining a right-handed helical portion of the slot. The left-handed helical portion and the right-handed helical portion are at different axial positions along the sleeve with respect to a center axis through the sleeve. Any of the foregoing embodiments may include any one of the following elements, alone or in combination with each other:

A tubing string, wherein the sleeve is sized so that the tubing string can be moved through the sleeve in an axial direction along the center axis.

A key coupled to the tubing string, wherein the key comprises: a first curved surface that substantially conforms to the portion of the first edge that defines the left-handed helical portion of the slot; and a second curved surface that substantially conforms to the portion of the second edge that defines the right-handed helical portion of the slot.

A coupling device coupled to the tubing string, wherein the coupling device couples the key to the tubing string.

The slot includes a landing portion so that, when the key moves within the slot and into the landing portion, the key locks the tubing string in a selected angular position relative to the sleeve.

The first curved surface of the key engages the portion of the first edge defining the left-handed helical portion of the slot to cause the key and the tubing string to rotate in a first rotational direction about the center axis when the tubing string is moved in an axial direction along the center axis through the sleeve.

The second curved surface of the key engages the portion of the second edge defining the right-handed helical portion of the slot to cause the key and the tubing string to rotate in a second rotational direction about the center axis when the tubing string is moved in the axial direction through the sleeve, wherein the second rotational direction is opposite the first rotational direction.

At least one of the first edge or the second edge includes a partitioning portion that extends circumferentially around at least a portion of the sleeve and separates the left-handed helical portion of the slot from the right-handed helical portion of the slot.

A casing string of which the sleeve is part.

The sleeve is coupled to a casing string and the slot includes a landing portion that is locked in a selected angular position relative to the casing string.

A casing string having inner threads along an inner surface of the casing string, wherein the sleeve has outer threads that engage the inner threads to lock the sleeve at a selected axial position relative to the casing string.

The sleeve has an inner surface that defines an inner diameter.

A tubing string, wherein the sleeve is sized so that the tubing string can be moved through the sleeve in an axial direction along the center axis; and a key coupled to the tubing string, wherein the key includes an elongate member and a projecting member that extends radially outward from the elongate member, wherein the projecting member comprises: a first curved surface that substantially conforms to the portion of the first edge defining the left-handed helical portion of the slot; and a second curved surface that substantially conforms to the portion of the second edge defining the right-handed helical portion of the slot.

Thus, a method for aligning a tubing string with a casing string has been described. Embodiments of the method may generally include moving a tubing string in an axial direction along a center axis through a sleeve such that a key coupled to the tubing string engages at least one of: a portion of a first edge of the sleeve that defines a left-handed helical portion of a slot in the sleeve; or a portion of a second edge of the sleeve that defines a right-handed helical portion of the slot; wherein the left-handed helical portion and the right-handed helical portion being at different axial positions along the sleeve with respect to the center axis; rotating the key in a first rotational direction about the center axis as the tubing string moves in the axial direction through the sleeve, when the key engages the portion of the first edge defining the left-handed helical portion of the slot; and rotating the key in a second rotational direction about the center axis as the tubing string moves in the axial direction through the sleeve, when the key engages the portion of the second edge defining the right-handed helical portion of the slot. Any of the foregoing embodiments may include any one of the following elements, alone or in combination with each other:

Rotating the key up to about 180 degrees in the first rotational direction about the center axis as the tubing string moves in the axial direction through the sleeve, when the key engages the left-handed helical portion of the first edge of the slot.

Rotating the key up to about 180 degrees in the second rotational direction about the center axis through the sleeve as the tubing string moves in the axial direction through the sleeve, when the key engages the right-handed helical portion defined by the first edge of the slot.

Moving the key into a landing portion of the slot so that the key locks the tubing string in a selected angular position relative to the sleeve.

Moving the key into the landing portion comprises moving the key into the landing portion of the slot so that the key locks the tubing string in the selected angular position relative to the sleeve and in a selected axial position relative to the sleeve.

Moving the tubing string in the axial direction comprises moving the tubing string in the axial direction through the sleeve such that a projecting member of the key extends radially outward from the tubing string and enters the slot within either the left-handed helical portion of the slot or the right-handed helical portion of the slot.

At least one of rotating the key in the first rotational direction or rotating the key in the second rotational direction causes the tubing string to align with a casing string to which the sleeve is coupled.

At least one of rotating the key in the first rotational direction or rotating the key in the second rotational direction causes a first component of the tubing string to align with a second component of a casing string to which the sleeve is coupled.

Rotating the key in both the first rotational direction and the second rotational direction rotates the key more than 180 degrees and up to about 360 degrees to thereby lock the tubing string in a selected angular position relative to a casing string to which the sleeve is coupled.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those skilled in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus comprising:

a sleeve having a slot defined by at least a first edge and a second edge of the sleeve, at least a portion of the first edge defining a left-handed helical portion of the slot, at least a portion of the second edge defining a right-handed helical portion of the slot, the left-handed helical portion and the right-handed helical portion being at different axial positions along the sleeve with respect to a center axis through the sleeve; and a tubing string or a casing string;

wherein a non-helical portion of the first edge overlaps axially with a portion of the second edge.

2. The apparatus of claim 1, further comprising the tubing string wherein the sleeve is sized so that the tubing string can be moved through the sleeve in an axial direction along the center axis.

3. The apparatus of claim 2, further comprising a key coupled to the tubing string, wherein the key comprises:

a first curved surface that substantially conforms to the portion of the first edge that defines the left-handed helical portion of the slot; and a second curved surface that substantially conforms to the portion of the second edge that defines the right-handed helical portion of the slot.

4. The apparatus of claim 3, further comprising a coupling device coupled to the tubing string, wherein the coupling device couples the key to the tubing string.

5. The apparatus of claim 4, wherein the slot includes a landing portion so that, when the key moves within the slot and into the landing portion, the key locks the tubing string in a selected angular position relative to the sleeve.

6. The apparatus of claim 3, wherein the first curved surface of the key is configured to engage the portion of the first edge defining the left-handed helical portion of the slot to cause the key and the tubing string to rotate in a first rotational direction about the center axis when the tubing string is moved in an axial direction along the center axis through the sleeve.

7. The apparatus of claim 6, wherein the second curved surface of the key is configured to engage the portion of the second edge defining the right-handed helical portion of the slot to cause the key and the tubing string to rotate in a second rotational direction about the center axis when the tubing string is moved in the axial direction through the sleeve, wherein the second rotational direction is opposite the first rotational direction.

8. The apparatus of claim 1, wherein at least one of the first edge or the second edge includes a partitioning portion that extends circumferentially around at least a portion of the sleeve and separates the left-handed helical portion of the slot from the right-handed helical portion of the slot.

9. The apparatus of claim 1, further comprising the casing string of which the sleeve is part.

10. The apparatus of claim 1, wherein the sleeve is coupled to the casing string and wherein the slot includes a landing portion that is locked in a selected angular position relative to the casing string.

11. The apparatus of claim 1, further comprising the casing string, the casing string having inner threads along an inner surface of the casing string, wherein the sleeve has outer threads that engage the inner threads to lock the sleeve at a selected axial position relative to the casing string.

12. The apparatus of claim 1, further comprising:

the tubing string, wherein the sleeve is sized so that the tubing string can be moved through the sleeve in an axial direction along the center axis; and a key coupled to the tubing string, wherein the key comprises:

an elongate member; and a projecting member that extends radially outward from the elongate member, the projecting member comprising:

a first curved surface that substantially conforms to the portion of the first edge defining the left-handed helical portion of the slot; and a second curved surface that substantially conforms to the portion of the second edge defining the right-handed helical portion of the slot.

13. A method, comprising:

moving a tubing string in an axial direction along a center axis through a sleeve such that a key coupled to the tubing string engages at least one of:

a portion of a first edge of the sleeve that defines a left-handed helical portion of a slot in the sleeve; or a portion of a second edge of the sleeve that defines a right-handed helical portion of the slot;

wherein the left-handed helical portion and the right-handed helical portion being at different axial positions along the sleeve with respect to the center axis;

wherein a non-helical portion of the first edge overlaps axially with a portion of the second edge;

rotating the key in a first rotational direction about the center axis as the tubing string moves in the axial direction through the sleeve, when the key engages the portion of the first edge defining the left-handed helical portion of the slot; and rotating the key in a second rotational direction about the center axis as the tubing string moves in the axial direction through the sleeve, when the key engages the portion of the second edge defining the right-handed helical portion of the slot.

14. The method of claim 13, wherein rotating the key in the first rotational direction comprises:

rotating the key up to about 180 degrees in the first rotational direction about the center axis as the tubing string moves in the axial direction through the sleeve, when the key engages the left-handed helical portion defined by the first edge of the slot.

15. The method of claim 13, wherein rotating the key in the second rotational direction comprises:

rotating the key up to about 180 degrees in the second rotational direction about the center axis through the sleeve as the tubing string moves in the axial direction through the sleeve, when the key engages the right-handed helical portion defined by the first edge of the slot.

16. The method of claim 13 further comprising:

moving the key into a landing portion of the slot so that the key locks the tubing string in a selected angular position relative to the sleeve.

17. The method of claim 16, wherein moving the key into the landing portion comprises:

moving the key into the landing portion of the slot so that the key locks the tubing string in the selected angular position relative to the sleeve and in a selected axial position relative to the sleeve.

18. The method of claim 13, wherein moving the tubing string in the axial direction comprises:

moving the tubing string in the axial direction through the sleeve such that a projecting member of the key extends radially outward from the tubing string and enters the slot within either the left-handed helical portion of the slot or the right-handed helical portion of the slot.

19. The method of claim 13, wherein at least one of rotating the key in the first rotational direction or rotating the key in the second rotational direction causes the tubing string to align with a casing string to which the sleeve is coupled.

20. The method of claim 13, wherein at least one of rotating the key in the first rotational direction or rotating the key in the second rotational direction causes a first component of the tubing string to align with a second component of a casing string to which the sleeve is coupled.

21. An apparatus comprising:

a sleeve having a slot defined by at least a first edge and a second edge of the sleeve, at least a portion of the first edge defining a left-handed helical portion of the slot, at least a portion of the second edge defining a right-handed helical portion of the slot, the left-handed helical portion and the right-handed helical portion being at different axial positions along the sleeve with respect to a center axis through the sleeve; and a tubing string or a casing string;

wherein the first edge defines a non-helical portion at an axial position of the right-handed helical portion of the second edge or the second edge defines a non-helical portion at an axial position of the left-handed helical portion of the first edge.

* * * * *